US006298562B1

(12) United States Patent
Duquette

(10) Patent No.: US 6,298,562 B1
(45) Date of Patent: Oct. 9, 2001

(54) APPARATUS FOR THE MARKING AND CUTTING OF CONSTRUCTION MATERIALS

(75) Inventor: David M Duquette, San Jose, CA (US)

(73) Assignee: David M. Duquette, San Jose, CA (US)

( * ) Notice: Subject to any disclaimer, the term of this patent is extended or adjusted under 35 U.S.C. 154(b) by 0 days.

(21) Appl. No.: 09/387,383

(22) Filed: Sep. 2, 1999

Related U.S. Application Data

(60) Provisional application No. 60/122,349, filed on Mar. 2, 1999.

(51) Int. Cl.[7] ..... B26B 11/00

(52) U.S. Cl. ..... 30/294; 30/162; 30/289; 30/293; 7/11.9; 7/163

(58) Field of Search ..... 30/123, 125, 142, 30/289, 293, 294, 329, 162; 7/158, 163, 164, 118, 119; 33/42, 668, 770, 755, 760, 765

(56) References Cited

U.S. PATENT DOCUMENTS

| | | | | |
|---|---|---|---|---|
| 302,057 | * | 7/1884 | Thurnauer | 7/119 |
| 460,147 | * | 9/1891 | Miles | 7/119 |
| 728,861 | * | 5/1903 | Carman | 7/119 |
| 905,766 | * | 12/1908 | Torka | 30/358 |
| 1,015,026 | * | 1/1912 | Jackson et al. | 7/119 |
| 1,346,393 | * | 7/1920 | Woodhouse | 30/296.1 |
| 2,641,834 | * | 6/1953 | Bobrowski et al. | 30/293 |
| 2,952,025 | | 9/1960 | Johnson . | |
| 4,255,856 | | 3/1981 | Mackie . | |
| 4,574,486 | * | 3/1986 | Drechsler | 33/765 |
| 4,602,397 | * | 7/1986 | Chao | 7/163 |
| 4,903,409 | | 2/1990 | Kaplan . | |
| 4,949,462 | | 8/1990 | Spencer . | |
| 4,974,320 | * | 12/1990 | Pelletier | 30/162 |
| 4,993,093 | | 2/1991 | Goldwitz . | |
| 5,206,965 | | 5/1993 | Rowly . | |
| 5,289,637 | * | 3/1994 | Coffey | 30/294 |
| 5,426,802 | * | 6/1995 | Greenwood | 7/164 |
| 5,542,184 | | 8/1996 | Beard . | |
| 5,557,818 | * | 9/1996 | Leon | 30/162 |
| 5,603,162 | * | 2/1997 | Chen | 30/162 |
| 5,829,152 | * | 11/1998 | Potter et al. | 33/668 |
| 5,966,820 | * | 10/1999 | Cornacchio et al. | 30/286 |

* cited by examiner

*Primary Examiner*—Hwel-Slu Payer

(57) ABSTRACT

An apparatus for marking and cutting of construction material, wherein the apparatus is adapted for use with a flexible measuring tape. The apparatus utilizes a main body in which a measuring tape is slideably engaged into a retaining slot. A protruding cutting wheel or marking material is set at a desired dimension and guided against a construction material in order to mark or cut the material at a uniform width. Movement of the apparatus along the work piece is easily accomplished since the angled tip or leader of a flexible measuring tape is used as a fence capable of sliding along the work piece with movement of the apparatus.

9 Claims, 3 Drawing Sheets

APPARATUS FOR THE MARKING AND CUTTING OF CONSTRUCTION MATERIALS

This application claim benefit to provisional application No. 60/122,349 Mar. 2, 1999.

BACKGROUND OF THE INVENTION

1. Field of the Invention

This invention relates generally to the field of hand tools and more particularly to an apparatus for the marking and cutting of construction materials, wherein the apparatus is adapted for use with a measuring tape.

2. Description of the Prior Art

Sheet materials such as drywall and plywood are commonly used in the construction industry. These sheet materials are usually supplied in selected sizes, such as 4 feet×8 feet. When installing these sheets it is often necessary to cut or mark strips of uniform width and this is generally accomplished by using a utility knife or a pencil, in conjunction with a measuring tape. The end of the tape measure is held against the side of the utility knife or pencil with the thumb and the tape is extended across the sheet to the desired width, holding the tape reel against the edge of the sheet. With the tape reel held in one hand and the knife or pencil in the other, both hands are moved down the sheet simultaneously such that the knife scores or a pencil marks a line parallel to the edge of the sheet. In the case of drywall, after scoreing the one side, the final cut is then made without the tape measure by using the knife along the scored line. The sheet is subsequently bent along the scored and cut line until it breaks, resulting in a strip of the desired width.

The method described above is awkward and inaccurate and various devices and methods have been designed by others attempting to solve these problems. For example, U.S. Pat. No. 5,542,184 (Beard, 1996) discloses a tape measure knife attachment for cutting drywall, utilizing the end segment and angled tab of a measuring tape in line with an extended knife blade. U.S. Pat. No. 5,206,965 (Rowley, 1993) discloses a knife having a housing with a thumb positioning structure associated with elongated sides. A measurement means is held in place against the thumb positioning structure by the users thumb. U.S. Pat. No. 4,993,093 (Goldwitz, 1991) discloses a utility knife having an elongated slot extending in the same plane as the cutting blade. The angled tip of a flexible ruler is retained within the elongated slot. U.S. Pat. No. 4,949,462 (Spencer, 1990) discloses a drywall device which includes a sleeve for slideably mounting on a stem of a T-square. A knife holder containing a knife is joined with the sleeve of the '462 patent. U.S. Pat. No. 4,903,409 (Kaplan et al., 1990) discloses a drywall scribing and scoring tool which includes a knife holding unit and scribe, units for attachment along an arm of a T-square. U.S. Pat. No. 4,255,856 (Mackie, 1981) discloses a utility knife having an attachment which permits the tape of a tape measure to be directly coupled to the knife. U.S. Pat. No. 2,952,025 (Johnson, 1960) discloses a knife which includes a reel containing a measuring tape and a guide structure at the outer end of the tape.

Known prior art, as exemplified by the above referenced patents, does not provide an adequate means to firmly hold a measuring tape in order to facilitate the marking and cutting of construction materials. For example, the cutting devices described in '184 '965 '093 '856 and '025 patents hold the end segment or angled tab of a measuring tape with an extended knife blade in line with the angled tab. In order to make a cut the user guides the measuring tape at an exact dimension along the edge of the work piece while simultaneously guiding the cutting device across the work piece. This process can be very awkward and prone to slipping from the desired dimension along the work piece edge. Furthermore, the prior art does not provide a means for the marking of construction material The '462 and '409 patents utilize T-squares. It is well known to those skilled in the art that the users of cutting devices and marking devices prefer that these devices are small to easily fit in a user's pocket or tool belt, enabling the user to move unencumbered on a construction site. T-squares for use with marking or cutting devices commonly have a relatively long arm or stem thus not fitting in the user's pocket and generally unsuitable for a tool belt.

Accordingly, the need exists for a marking and cutting device that firmly holds a measuring tape in preparation for marking and cutting of construction materials having improved ease of use and improved cutting accuracy.

SUMMARY OF THE INVENTION

An object of the present invention is to provide an apparatus for the efficient and accurate cutting and marking of construction materials.

Another object of the invention is to provide an apparatus to firmly hold a measuring tape at a desired dimension to facilitate the cutting and marking of construction materials.

In accordance with the preferred embodiments of the present invention, an apparatus for marking of construction sheet materials adapted for use with a flexible measuring tape comprises a main body, a measuring tape retaining slot, and one or more measuring tape viewing windows.

Other objects and advantages of the present invention will become apparent from the following descriptions, taken in connection with the accompanying drawings, wherein, by way of illustration and example, two embodiments of the present invention are disclosed.

BRIEF DESCRIPTION OF THE DRAWINGS

The drawings constitute a part of this specification and include exemplary embodiments to the invention, which may be embodied in various form. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Throughout the following description references will be made to the drawings and the same numerals will be used throughout the several views to indicate the same parts of the invention.

Figure 1:
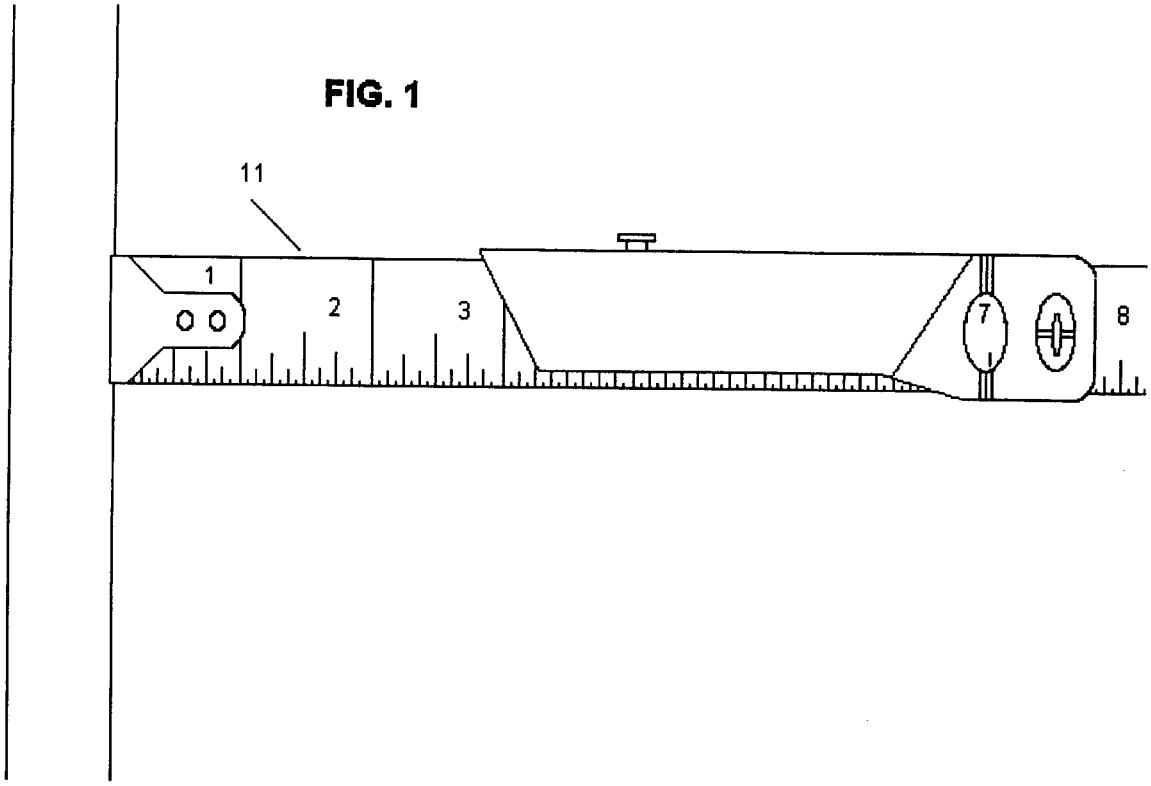
FIG. 1 is a left plan view of the invention with a measuring tape engaged and extended to a work piece.

In accordance with a preferred embodiment of the invention shown in the left plan view in FIG. 1, the utility knife of the invention generally denoted by the numeral 10 has a measuring tape 11 slidably engaged on the utility knife and is extended across a workpiece.

Figure 2:
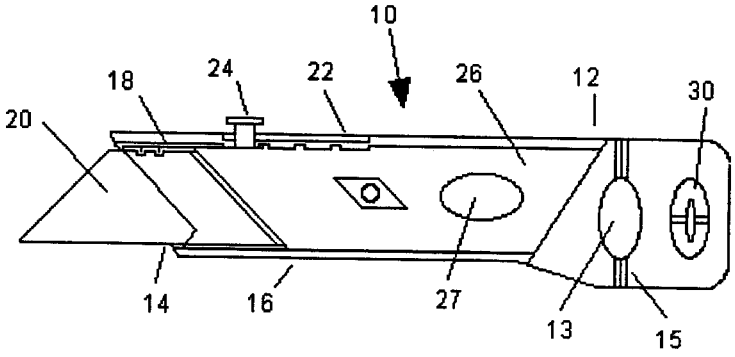
FIG. 2 is a right plan view of the invention.

In FIG. 2, the utility knife 10 has an elongated. handle 12 and a blade-receiving slot opening 14 at one end thereof. The handle 12 has a main body 16 and a main body cover plate (FIG. 3, 36), detachably secured and separable along a longitudinal plane for the purpose of changing a cutting blade 20 or accessing the blade or graphite holders 26 and 27. A carrier 18 is reciprocally mounted on the main body 16 for movement toward and away from the slot opening 14. A cutting blade 20 is supported on the carrier 18. An elongated tongue 22 rearwardly extends from the carrier 18 for movement thereof. In addition, a locking cam surface 24 is on the handle 12. The locking cam surface 24 defines a plurality of locking abutments for slideably reciprocating the carrier 18 within the handle 12.

A blade holder 26 for storing additional blades is at the end of the elongated handle 12 opposite to the blade-receiving slot opening. Within. the blade holder 26 is a graphite holder 27 for the storing of additional marking material such as graphite strips.

Figure 4:
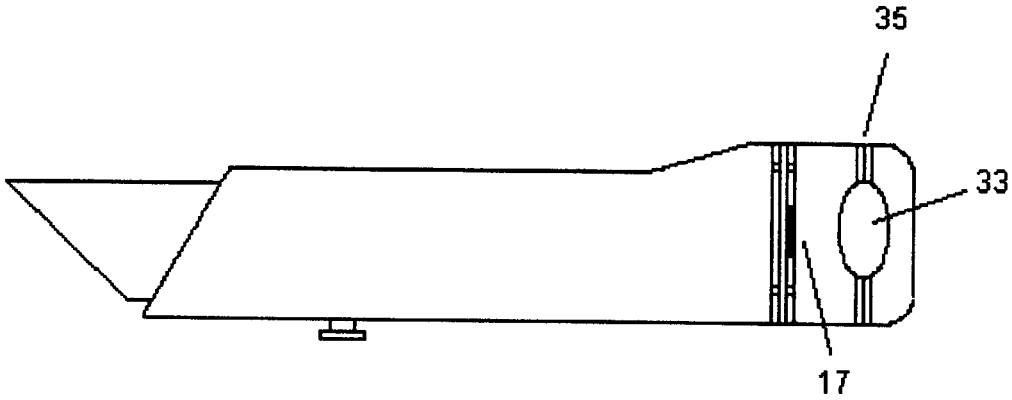
FIG. 4 is a left plan view of the invention.

A toothed cutting wheel 30 is affixed to the side of the handle 12 directly opposite a measuring tape viewing window (FIG. 4, 33) and is coplanar with a measuring tape centering groove (FIG. 4, 35). The measuring tape viewing window 13 is located on the side of the handle 12 directly opposite a marking material (FIG. 4, 17) and measuring tape centering groove 15 is directly opposite and coplanar with marking material (FIG. 4, 17).

Figure 3:
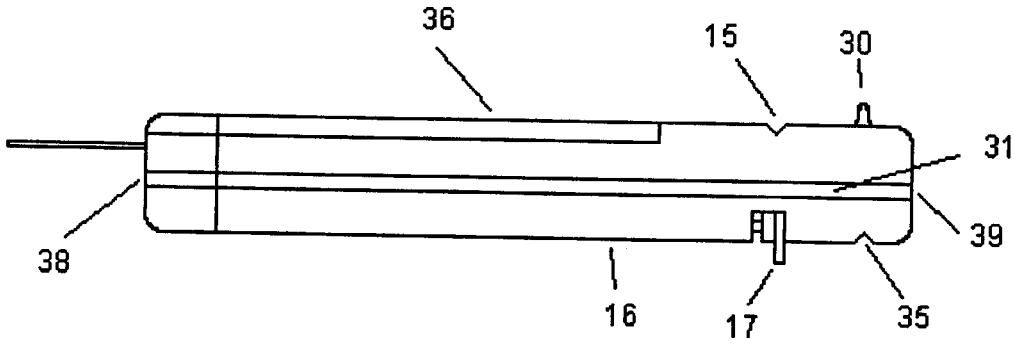
FIG. 3 is a bottom plan view of the invention.

In FIG. 3, the measuring tape retaining slot 31 runs through the main body 16 and is located on the bottom of the main body 16 and between the first end portion 38 and the second end portion 39 and is open on one side of the main body. The measuring tape retaining slot 31 runs perpendicular to toothed cutting wheel 30 and marking material 17.

In FIG. 4, the marking material 17 is removably affixed to and extended from the side of the handle 12, the marking material 17 is directly opposite and coplanar with a measuring tape centering groove (FIG. 3, 15).

Figure 5:
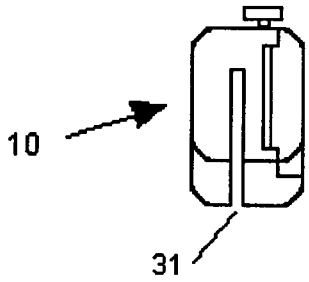
FIG. 5 is a front plan view of the invention.

In FIG. 5, the measuring tape retaining slot 31 runs parallel with the utility knife 10 and has a sufficient width and depth to firmly hold a measuring tape by flattening the concave structure of a measuring tape.

Figure 6:
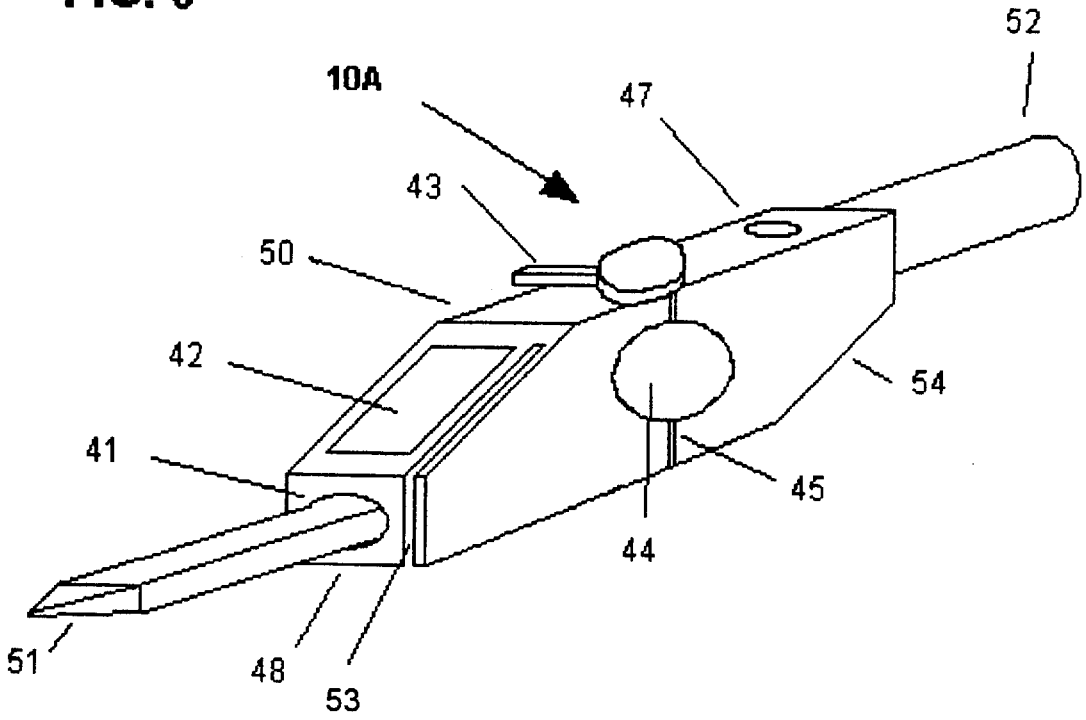
FIG. 6 is a perspective view of a marking tool in accordance with the present invention.

Turning now to FIG. 6 it should be noted that another embodiment 10A of the invention is depicted. The marking tool 10A includes a main body 50 and two writing implement cavities 41 and 42 running parallel through the main body 50. Set screws 47 and 48 are located on the opposite side as shown in FIG. 6 perpendicular to the writing implement cavities 41 and 42 and are used for detachably securing writing implements 51 and 52 within the writing implement cavities 41 and 42. Marking material 43 is detachably secured and protruding from the main body 50 and is opposite measuring tape viewing window 44 and is coplanar with measuring tape centering groove 45. The measuring tape centering groove 45 is used for centering the marking material 43 on a desired dimension in preparation for marking a work piece.

Figure 7:
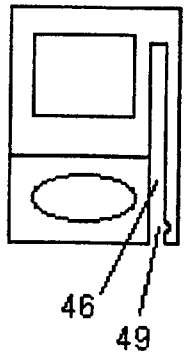
FIG. 7 is a front plan view of the marking tool.

In, FIG. 7 the measuring tape retaining slot 46 runs through the main body 50 between the first end portion (FIG. 6,53) and the second end portion (FIG. 6,54) and is open on one side of main body 50 and has a sufficient width and depth to firmly hold a measuring tape by flattening the concave structure of a measuring tape. A measuring tape retaining groove 49 runs parallel with and inside of the measuring tape retaining slot 46. The purpose of the measuring tape retaining groove 49 is to assist in firmly holding a measuring tape.

Method of use

It can be readily understood from the above description and the drawings, an advantageous method of using the present invention exists. As described above, the invention includes a handle 12 with a razor-cutting blade 20 on the first end and a toothed cutting wheel 30 and marking material 17 on the second end. The second end includes measuring tape viewing windows 13 and 33 to facilitate the setting of a measuring tape at a desired dimension coplanar with cutting wheel 30 or a marking material 17, inside the measuring tape retaining slot 31.

The invention is used in its preferred embodiment by slideably engaging a measuring tape to a desired dimension. The operator then holds the invention 10 in one hand and the measuring tape end against a work piece in the other hand. The toothed cutting wheel 30 or the marking material 17 is then pressed against the work piece such that it scores or marks the surface of the work piece. In the case of scoring drywall it can then be snapped back such that the razor-cutting blade 20 may be used to cut the face paper on the backside of the drywall.

In the second embodiment the same procedure is used by first slidably engaging a measuring tape into the measuring tape retaining slot 46 at a desired dimension by centering the actual dimension on a tape measure in the measuring tape viewing window 44 on the measuring tape centering groove 45. The operator then holds the marking tool in one hand and the measuring tape end against a work piece edge in the other hand. The operator then simultaneously slides both the marking tool 10A and the end of a measuring tape across a workpiece taking care to press the marking material 43 such as pencil lead against the workpiece. Leaving the desired mark at a uniform width from the edge of a work piece.

While the invention has been described in connection with two preferred embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for marking construction sheet materials, wherein the apparatus is adapted for use with a flexible measuring tape, comprising:

a main body having a first end portion and a second end portion;

a measuring tape-retaining slot formed in the main body for removably engaging a flexible measuring tape wherein said slot opens on one side of said main body and runs between said first end portion and said second end portion, said slot has sufficient width and depth to firmly hold a measuring tape by flatening a concave structure of the measuring tape;

a marking or cutting device protruding outwardly from said main body used for the marking or cutting of construction sheet material.

2. An apparatus as claimed in claim 1 wherein said main body includes a blade receiving slot opening at said first end portion, said main body having two matching members detachably secured and separable along a longitudinal plane, a carrier reciprocally mounted on one of said members for movement toward and away from said slot opening, a cutting blade supported on said carrier, an elongated tongue rearwardly extending from said carrier for movement thereof, and a locking cam surface on the main body defining a plurality of locking abutments for slideably reciprocating the said carrier within said main body.

3. An apparatus as claimed in claim 1 wherein said measuring tape-retaining slot is comprised of a channel that runs parallel to said main body and runs through said first end portion and said second end portion of said main body, said measuring tape-retaining slot is constructed and arranged to selectively receive and engage the flexible measuring tape such that the measuring tape can extend parallel from a longitudinal plane.

4. An apparatus as claimed in claim 1 further comprising a measuring tape viewing window having an opening in a side of said main body running perpendicular and open to said measuring tape-retaining slot, said measuring tape viewing window is constructed and arranged to facilitate the reading of dimensions on the measuring tape while it is engaged in said measuring tape-retaining slot.

5. An apparatus as claimed in claim 4 wherein said measuring tape viewing window further comprises a groove running perpendicular to said main body, said groove is centered on said measuring tape viewing window, said groove is constructed and arranged to facilitate the setting of the measuring tape at an exact dimension in relation to said marking or-cutting device.

6. An apparatus as claimed in claim 1 wherein said marking or cutting device comprises a cutting wheel affixed to said main body, said cutting wheel protrudes from a side of said main body.

7. An apparatus as claimed in claim 1 wherein said marking device is removably affixed to and protruding from said main body.

8. An apparatus as claimed in claim 1 wherein said main body including a blade receiving slot opening at said first end portion, said main body having two mating members detachably secured and separable along a longitudinal plane, a cutting blade supported between said members and extending through said blade receiving slot opening from said first end portion.

9. An apparatus as claimed in claim 1 wherein said measuring tape-retaining slot further comprises a measuring tape retaining groove that runs parallel with and inside the measuring tape-retaining slot.

* * * * *